US010519767B2

(12) United States Patent
Lehr

(10) Patent No.: US 10,519,767 B2
(45) Date of Patent: Dec. 31, 2019

(54) ADAPTIVE SHELL MODULE WITH EMBEDDED FUNCTIONALITY

(71) Applicant: BAKER HUGHES INCORPORATED, Houston, TX (US)

(72) Inventor: Joerg Lehr, Lower Saxony (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 14/812,716

(22) Filed: Jul. 29, 2015

(65) Prior Publication Data

US 2017/0030188 A1 Feb. 2, 2017

(51) Int. Cl.

| | |
|---|---|
| ***E21B 49/00*** | (2006.01) |
| ***E21B 47/00*** | (2012.01) |
| ***E21B 47/01*** | (2012.01) |
| ***E21B 17/20*** | (2006.01) |

(52) U.S. Cl.

CPC ..... *E21B 49/00* (2013.01); *E21B 47/00* (2013.01)

(58) Field of Classification Search

CPC ..... E21B 47/01; E21B 47/011; E21B 17/20; E21B 49/005; E21B 49/00

See application file for complete search history.

(56) References Cited

U.S. PATENT DOCUMENTS 3,635,296 A * 1/1972 Lebourg ..... E21B 10/46 175/404
4,421,345 A * 12/1983 Ayers ..... F16L 27/10 285/223
5,320,179 A * 6/1994 Roos, Jr. ..... E21B 47/011 166/65.1
6,300,762 B1 * 10/2001 Thomas, Jr. ..... E21B 47/011 324/338
6,483,310 B1 11/2002 Meador
6,577,244 B1 * 6/2003 Clark ..... E21B 47/011 324/339
2007/0216417 A1 * 9/2007 Ritter ..... G01V 3/20 324/367
2008/0041629 A1 2/2008 Aronstam et al.
2009/0179648 A1 7/2009 Fredette et al.
2011/0240368 A1 10/2011 Allen et al.
2011/0308858 A1 12/2011 Menger et al.
2014/0174831 A1 6/2014 Sitka

OTHER PUBLICATIONS

PCT/US2016/044362—International Search Report dated Nov. 9, 2016.

* cited by examiner

*Primary Examiner* — Taras P Bemko
*Assistant Examiner* — Manuel C Portocarrero
(74) *Attorney, Agent, or Firm* — Mossman, Kumar & Tyler, PC

(57) ABSTRACT

An apparatus for use in a borehole formed in an earthen formation includes a flex sub having a reduced diameter flex section connecting a first end to a second end, the flex section having a surface radially recessed from an outer surface of the first end and a second end and a shell disposed around the radially recessed surface. The shell is more flexible than the flex section. The shell includes at least one module that has at least one sensor embedded in the shell that estimates a selected parameter of interest. The apparatus may also include a positioning module connected to the flex sub, the positioning module having a plurality of independently extendable ribs configured to selectively laterally position the flex sub in the borehole.

18 Claims, 4 Drawing Sheets

ADAPTIVE SHELL MODULE WITH EMBEDDED FUNCTIONALITY

CROSS REFERENCE TO RELATED APPLICATIONS

None.

BACKGROUND OF THE DISCLOSURE

1. Field of the Disclosure

This disclosure relates generally to systems and devices used in subsurface boreholes.

2. Description of the Related Art

To obtain hydrocarbons such as oil and gas, boreholes or wellbores are drilled by rotating a drill bit attached to the bottom of a drilling assembly (also referred to herein as a "Bottom Hole Assembly" or ("BHA"). The drilling assembly is attached to the bottom of a tubing or tubular string, which is usually either a jointed rigid pipe (or "drill pipe") or a relatively flexible spoolable tubing commonly referred to in the art as "coiled tubing." The string comprising the tubing and the drilling assembly is usually referred to as the "drill string." When jointed pipe is utilized as the tubing, the drill bit is rotated by rotating the jointed pipe from the surface and/or by a mud motor contained in the drilling assembly. In the case of a coiled tubing, the drill bit is rotated by the mud motor. During drilling, a drilling fluid (also referred to as the "mud") is supplied under pressure into the tubing. The drilling fluid passes through the drilling assembly and then discharges at the drill bit bottom. The drilling fluid provides lubrication to the drill bit and carries to the surface rock pieces disintegrated by the drill bit in drilling the wellbore via an annulus between the drill string and the wellbore wall. The mud motor is rotated by the drilling fluid passing through the drilling assembly. A drive shaft connected to the motor and the drill bit rotates the drill bit.

A substantial proportion of the current drilling activity involves drilling of deviated and horizontal wellbores to more fully exploit hydrocarbon reservoirs. Such boreholes can have relatively complex well profiles that may include contoured sections. Conducting well operations in such boreholes may require using work string that includes one or more flexible sections. The present disclosure relates to enhanced functionality of such flexible sections.

SUMMARY OF THE DISCLOSURE

In aspects, the present disclosure provides an apparatus for use in a borehole formed in an earthen formation. The apparatus may include a flex sub having a reduced diameter flex section connecting a first end to a second end. The flex section has a surface radially recessed from an outer surfaces of the first and second ends. The apparatus also includes a shell disposed around the radially recessed surface. The shell may be configured to be more flexible than the flex section. In embodiments, the shell may include at least one module that has at least one sensor embedded in the shell. The at least one sensor ma bye configured to estimate a selected parameter of interest. The apparatus may also include a positioning module connected to the flex sub. The positioning module may have a plurality of independently extendable ribs configured to selectively laterally position the flex sub in the borehole.

In a related method, a work string including the flex sub and shell may be conveyed along the wellbore. The method may include laterally displacing the flex sub using the positioning module and estimating the selected parameter of interest using the at least one module while the flex sub is at two or more different lateral positions.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

Figure 1:
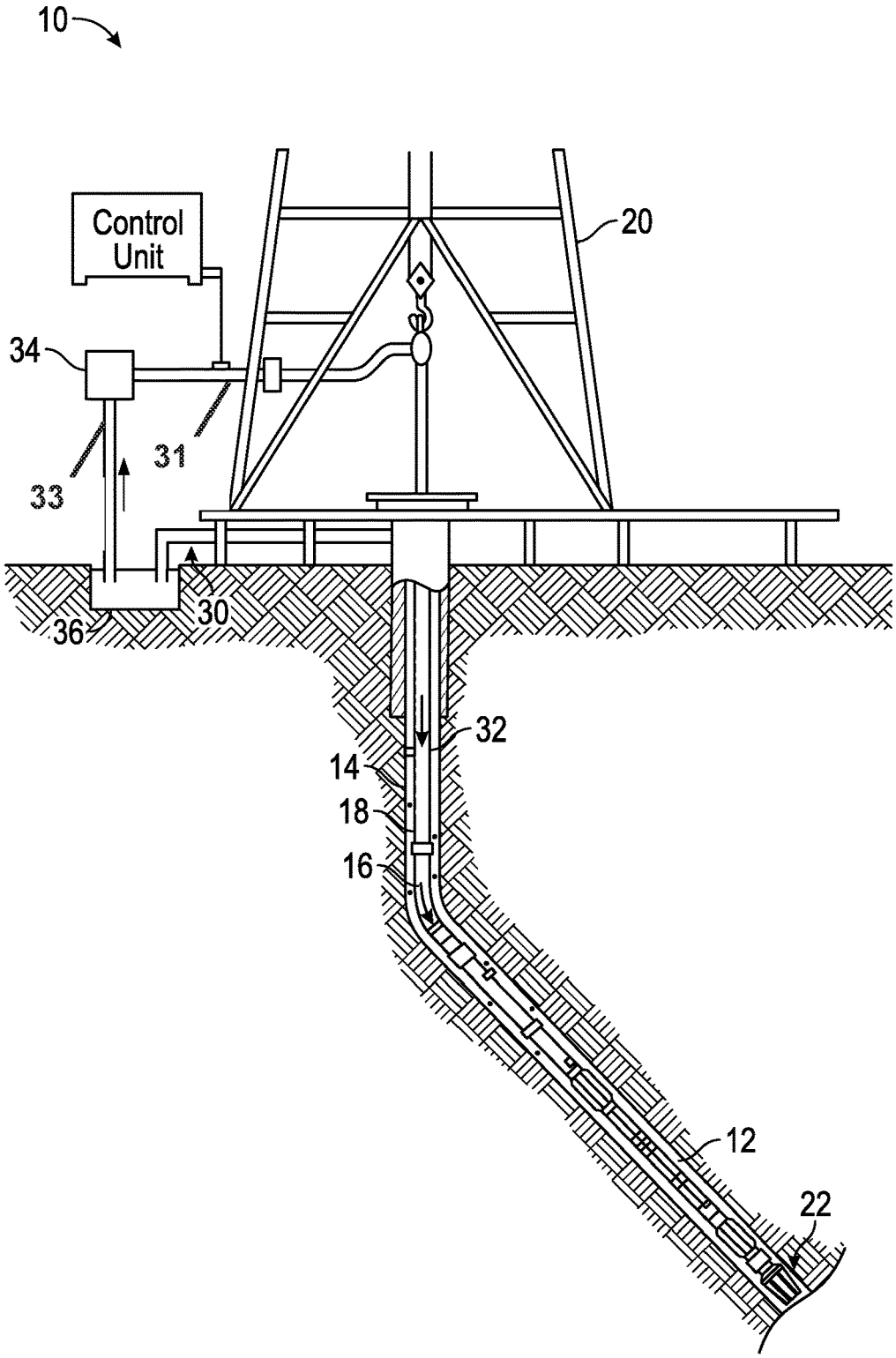
FIG. 1 illustrates a drilling system that incorporates one or more shells in accordance with the present disclosure.

Referring now to FIG. 1, there is shown an embodiment of a drilling system 10 that may use the filtering devices and methods according to the present disclosure. While a land-based rig is shown, these concepts and the methods are equally applicable to offshore drilling systems. The system 10 shown in FIG. 1 has a bottomhole assembly (BHA) 12 conveyed in a borehole 14 via work string such as a drill string 16. The BHA 12 may include a steering unit, a drilling motor, a sensor sub, a bidirectional communication and power module, stabilizers, a formation evaluation sub, and other known equipment. The drill string 16 includes a tubular string 18, which may be drill pipe or coiled tubing, extending downward from a rig 20 into the borehole 14. A drill bit 22, attached to the drill string end, disintegrates the geological formations when it is rotated to drill the borehole 14.

During operation, one or more mud pumps 34 at the surface draw the drilling fluid, or "drilling mud," from a mud pit 36 and pump the drilling mud via the surface section 33 of the conduit 31 into the borehole 14 via the drill string 16. The drilling mud exits at the drill bit 22 and flows up the annulus 32 to the surface. The returning drilling fluid may be processed, cleaned and returned to the mud pit 36 or disposed of in a suitable manner. The circulating drilling mud serves a number of functions, including cooling and lubricating the drill bit 22, cleaning the borehole of cuttings and debris, and maintaining a suitable fluid pressure in the wellbore (e.g., an overbalanced or at-balanced condition). In a sliding drilling mode, only the drilling motor rotates the drill bit 22. In another drilling mode, the rotation of the drill string 16 is superimposed on the drilling motor rotation.

Figure 2:
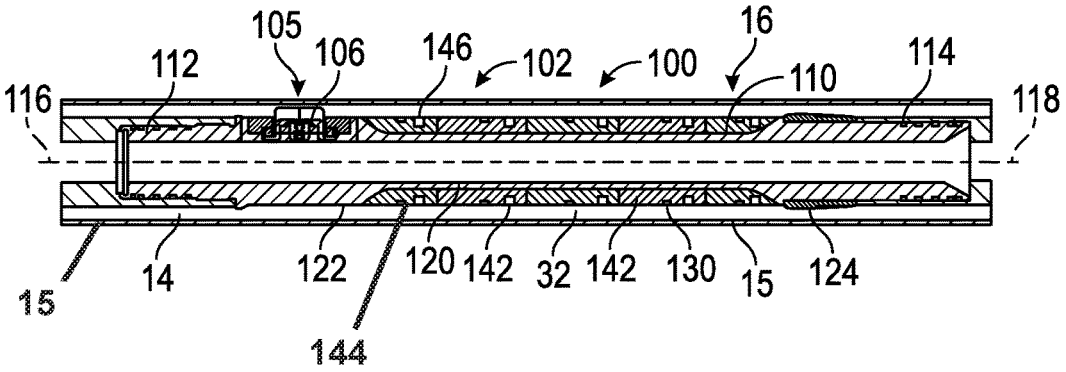
FIG. 2 sectionally illustrates a side section of a flex sub that includes a shell made in accordance with embodiments of the present disclosure.

Referring now to FIG. 2, there is sectionally shown a portion of the drill string 16 disposed in a borehole 14. The segment includes a flex sub 100 that is at least partially enclosed by a shell 102. In some arrangements, the segment may also include a positioning module 105 that has one or more active rib elements 106. The rib elements 106 can extend and retract radially and may be independently adjustable. This independent movement of the rib elements 106 can laterally displace and position the flex sub 100 concentrically or eccentrically in the borehole 14. For example, the rib elements 106 may be positioned to move the flex sub 100, and/or connected BHA modules, immediately adjacent to or in contact with a borehole wall 15. These connected BHA modules (not shown) can be positioned between the flex sub 100 and the positioning module 105. Such illustrative BHA modules may include logging tools, borehole calipers, sensors, fluid sampling tools, coring devices, etc. By lateral displacement, it is meant movement of in a radial direction relative to a longitudinal axis of the borehole 14. This controlled movement is forming an Integrated and Narrated Evaluation System (INES) able to perform advanced analysis of the drilling fluid conditions within the annulus 32, the wall of the wellbore 14 and the geological formations.

To enable the drill string 16 to accommodate bending while traversing the borehole 14, the flex sub 100 is formed as a flexible tubular structure. The flex sub 100 has a reduced diameter flex section 110 to enable the ends 112, 114 of the flex sub 100 to deflect relative to one another. That is, the flex section 110 is specifically engineered to enable a tool axis 116 of the end 112 to be misaligned a predetermined amount with a tool axis 118 of end 114. This misalignment is typically a bend in the flex section 110. The reduction in diameter results in the entire outer surface 120 of the flex section 110 to be continuously radially recessed relative the adjacent surfaces 122, 124 of the flex sub 100. This is in contrast to pockets or cavities that form a discontinuous radially recessed surface. Additionally, the flex section 110 may have a continuous wall thickness between the ends 112, 114 that is smaller than the thickness of the walls of the ends 112, 114. This is in contrast to pockets or cavities formed in a surface that forms a discontinuous smaller wall thickness.

Figure 3:
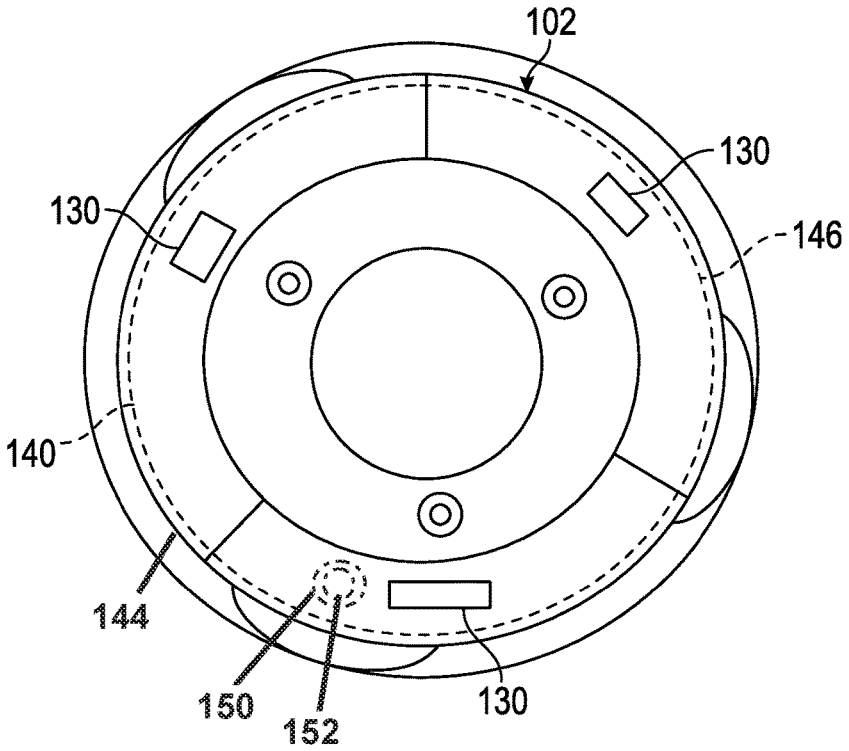
FIG. 3 is a cross-sectional view of the FIG. 2 embodiment.

Referring to FIG. 3, in one non-limiting embodiment of the present disclosure, the shell 102 is configured as a flexible body that fills and surrounds the radially recessed portion of the flex section 110. The diameter of the shell 102 may be selected to have an outer surface 144 that is flush with the adjacent surfaces 122, 124. Thus, a relatively constant sized annular flow space 32 is formed between the flow sub 100 and the borehole wall 15. Therefore, fluid flowing in the flow space 32 will not encounter significant changes in flow velocity. Moreover, filling the recessed portion minimizes the likelihood of debris being trapped along the flow space 32.

In one arrangement, the shell 102 is configured to be more flexible than the flex section 110. Thus, as a minimum, the shell 102 does not measurably inhibit or prevent the flex section 110 from bending under normal operation. The flexibility may be obtained by forming the shell 102 from one or more materials that are more flexible than the metal or other material making up the flex section 110. For instance, the shell 102 may be formed of an elastomer; e.g., plastic, rubber, silicone, etc., or a material having a Modulus of Elasticity in the same range as elastomers. The shell 102 may also be formed of materials, such as plastics, that become more flexible when exposed to ambient borehole temperatures. Additionally or alternatively, the shell 102 may be segmented to allow the desired axial deformation as discussed below.

Referring to FIGS. 2 and 3, in embodiments, the shell 102 may be segmented axially and/or circumferentially. In the illustrated embodiment, the shell 102 has three circumferentially distributed segments 140 and five axially distributed segments 142. In this case, the fifteen shell segments in summary will give the design enough aggregate flexibility to follow the elastic deformation of the flex section 110. For clarity, only one of each such segment has been labeled. It should be understood that greater or fewer segments may be used and in some embodiments, the shell 102 may be a single unitary overmold.

Figure 4:
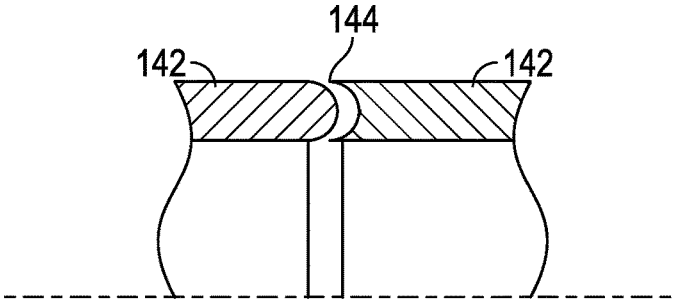
FIG. 4 illustrates a side view of an alternate embodiment of a shell according to the present disclosure.

Referring to FIG. 4, there is shown an arrangement for making the shell 102 axially flexible by appropriately shaping and interconnecting the axially aligned segments 142. For instance, the segments 142 may have ends 144 that are shaped to form a ball joint or other similar connection that allows relative pivoting or sliding. Such configurations may allow the individual segments 114 to be formed of rigid material such as metal or composite while accommodating a large degree of bending of the flex section 110.

Referring to FIGS. 2 and 3, in embodiments, a binding element 146, such as a ring, band, or strap, may be used to secure the individual segments of the shell 102 to the flex section 110. The utilization of ring band made of Shape Memory Alloy (SMA) might be a reliable solution for down-hole applications. Of course, in other embodiments, fastening elements such as screws or rivets may be used.

In some embodiments, the shell 102 may include one or more modules 130 configured to estimate one or more parameters of interest relating to the formation, the borehole, one or more fluids in the borehole, and/or the drill string 16. The modules 130 may be configured to acquire, process, store, and/or transmit information as needed for a particular situation. In one arrangement, the modules 130 may be embedded into one or more segments 140, 142 of the shell 102. Exemplary sensors within the modules 130 may include, but are not limited to, formation evaluation tools, radiation detectors, gamma ray detectors, casing collar locators, pressure sensors, temperature sensors, NMR tools, wellbore calipers, directional survey tools, acoustic tools, borehole calipers, fluid analysis tools, accelerometer, odometers, magnetometers, gyroscopes, etc.

For autonomous operations, the module 130 may be completely self-contained and include one or more sensors, microprocessors programmed with algorithms and instructions, memory modules, batteries, and transceivers. In other embodiments, the module 130 may interact with power and/or signal sources embedded in the flex section 110. For example, the flex section 110 may include one or more bores 150 that house signal/power communication hardware 152 (e.g., signal carriers such as wires and fibers, induction hardware, etc.). In such embodiments, the module 130 may include only sensors and associated circuitry. The modules 130 may use induction to exchange data/power with the hardware 152. In still other embodiments, the module 130 may be configured to only measure parameters of interest and store the sensor measurements onboard. The stored measurements may be retrieved at the surface by removing the module 130 from the flex section 110. It should be understood that the above arrangements are non-limiting and only illustrative of the various configurations that may used for the module 130.

Figure 5:
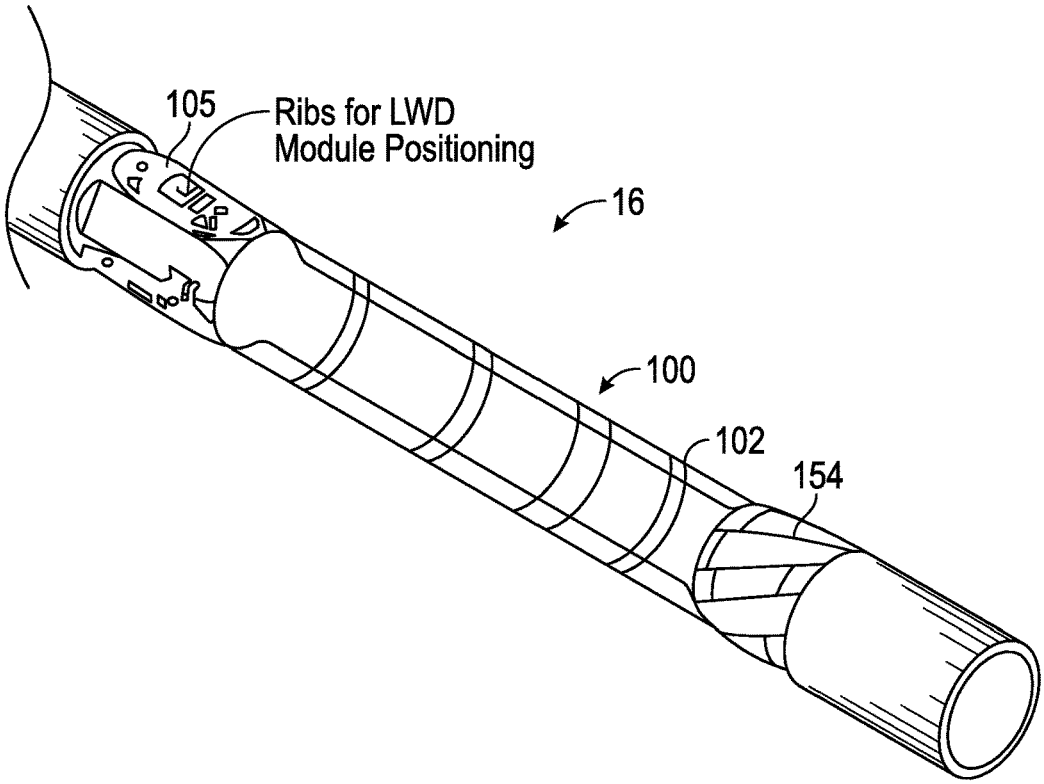
FIG. 5 isometrically illustrates one embodiment of a flexible section according to the present disclosure.

Referring now to FIG. 5, there is isometrically shown the flex sub 100 and the shell 102 positioned along a drill string 16 that includes active rib elements 106 and a centralizer 154. The rib elements may also be referred to as force application members, as pads or extensible member. A power source (not shown) for actuating the rib elements 106 may be a hydraulic device, screw device, linear electrical device, an electromechanical device, Shape Memory Alloy (SMA) or any other suitable device. Each rib element 106 may be independently actuated to extend radially a module 107 to apply a selected amount of force on the wellbore wall while the drill string 16 is stationary or moving.

Figure 6A:
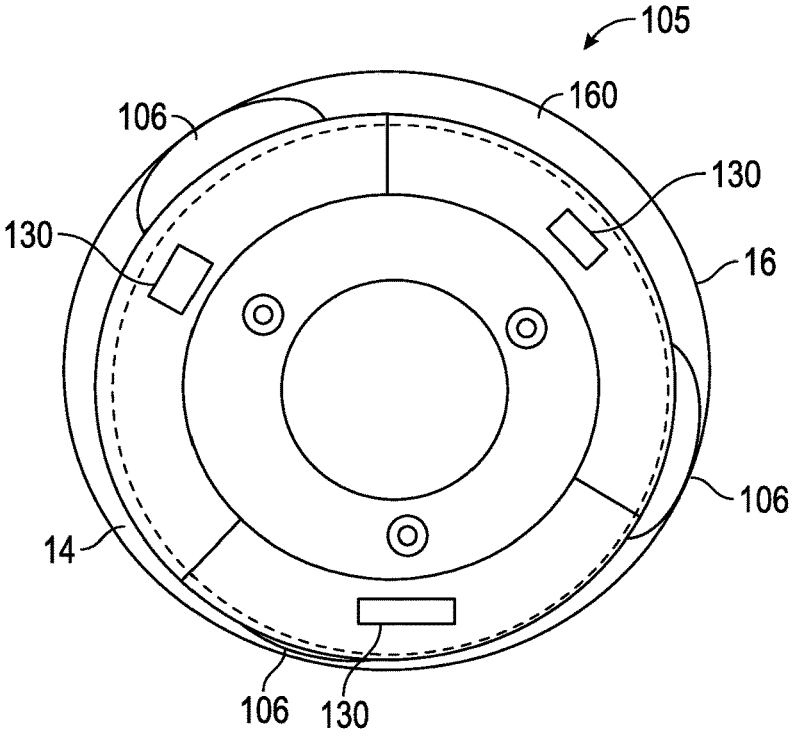
FIGS. 6A-B schematically illustrate end views of the positioning module laterally displacing the flex sub at two different lateral positions in the borehole.
Figure 6B:
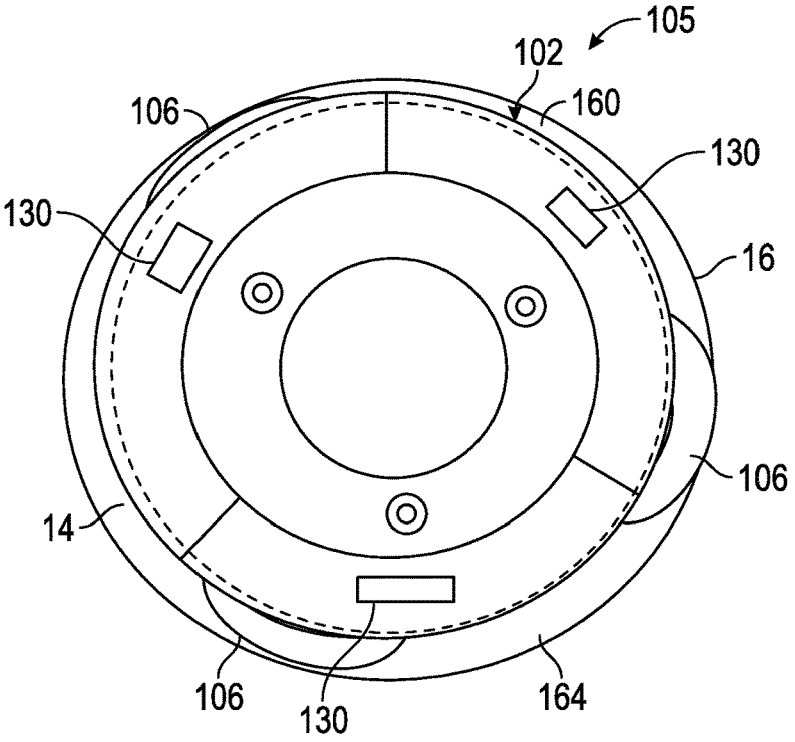

Referring to FIGS. 6A and B, the positioning module 105 may be used in conjunction with the sensor modules 130 to perform differential measurements. For example, the sensor modules 130 may be shifted to thereby move a pulsed electro-magnetic field while scanning a region or volume of interest. The region or volume of interest may be the drilling fluid in the annulus 32 or the formation adjacent the borehole wall 16. In FIG. 6A, the ribs 106 have been independently actuated to position the modules 130 remotely from a region 160 in the borehole 14. In FIG. 6B, the ribs 106 have been independently actuated to position the modules 130 close to the region 160 in the borehole 14. Thus, the beam or wave (e.g., magnetic, radiation, acoustic, etc.) used to investigate a region of interest has been emitted from two different lateral locations. Therefore, the beam or wave will travel at different distances between a transmitter and a receiver. Moreover, the beam or wave may travel through different media, e.g., earth or drilling fluid. Making such differential measurements may provide better data resolution, a better transmission window, and/or additional data collection. In addition to providing information about the formation, such measurements may be useful to determine the effectiveness of hole cleaning along a borehole low side 164 along the borehole 14.

It should be appreciated that the devices of the present disclosure are susceptible to numerous operating modes. For instance, sensor measurements may be continuously or periodically retrieved from the modules 130 while drilling and communicated to another downhole location or to the surface by using a "short hop" wireless system, inductive communication hardware, and/or wired pipe technology. Of course, other systems, such as mud pulse telemetry systems may also be used. In another operating mode, the information in the modules 120 may be read out or exchanged at the surface. For example, after the modules 130 have been extracted from the borehole 14, personnel at the surface may wirelessly transfer information from the memory modules of the modules 130. Such a mode may allow for fast rerun maintenance and operation without braking of BHA or drill-string connections or opening of hatches. Alternatively or additionally, the shell 102 may be disassembled and the modules 130 may be plugged via a physical connection to an information extraction device such as a microprocessor.

Also, it should be understood that the flex section 100 may be used in conjunction with any work string used in a borehole. For instance, the flex section 100 and shell 102 may be used with non-rigid strings such as coiled tubing or wirelines. Also, the shells 102 of the present disclosure may be used with other conveyance systems such as self-propelled tractors. In still other embodiments, the positioning module 105 may include a non-rotating sleeve on which the rib elements 106 are disposed. An internal bearing arrangement can allow the drill string 16 to rotate relative to the positioning module 105. Thus, the rib elements 106 remain generally stationary relative to the borehole wall 15. In such arrangements, the modules 130 may be rotating and may perform circumferential scanning of the surrounding formation. Also, the modules 130 may operate while the drill string 16 is stationary or while axially sliding.

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. An apparatus for use in a borehole formed in an earthen formation, comprising:

a drill string;

a flex sub positioned along the drill string, the flex sub having a reduced diameter flex section connecting a first end to a second end, the flex section having a surface radially recessed from an outer surfaces of the first and second ends, the flex sub having a bore extending from the first end to the second end;

a shell disposed around the radially recessed surface, the shell being configured to be more flexible than the flex section;

wherein the drill string and the flex sub convey a drilling fluid to an exit of the drill string; and wherein:

the shell is formed of segments;

the flex section is made of a metal and the segments are formed of a non-metal; and at least one module is embedded in the shell.

2. The apparatus of claim 1, wherein the shell fills a radially recessed portion defined by the radially recessed surface and includes at least one module configured to estimate a selected parameter of interest.

3. The apparatus of claim 1, wherein the shell fills a radially recessed portion defined by the radially recessed surface and has an outer surface that is flush with the outer surfaces of the first and second ends, and wherein at least one module in the radially recessed includes at least one sensor embedded in the shell, the at least one sensor being configured to estimate a selected parameter of interest.

4. The apparatus of claim 3, wherein the module further includes at least one of: (i) memory module storing information related to the estimated selected parameter of interest, (ii) a transmitter transmitting the information related to the estimated selected parameter of interest, and (iii) a battery supplying power to the at least one sensor.

5. The apparatus of claim 3, further comprising at least one signal carrier extending through the flex section, the at least one sensor being in signal communication with the at least one signal carrier.

6. The apparatus of claim 1, wherein the shell includes a plurality of segments.

7. The apparatus of claim 6, wherein the segments are distributed at least one of: (i) circumferentially, and (ii) axially.

8. The apparatus of claim 6, wherein the shell is formed of a material that is more flexible than a material forming the flex section.

9. The apparatus of claim 1, further comprising a positioning module connected to the flex sub, the positioning module having a plurality of independently extendable ribs configured to selectively laterally position the flex sub in the borehole.

10. The apparatus of claim 1, wherein the at least one module is one of: (i) a memory module storing information related to the estimated selected parameter of interest, (ii) a transmitter transmitting the information related to the estimated selected parameter of interest, and (iii) a battery supplying power to the at least one sensor.

11. An apparatus for use in a borehole formed in an earthen formation, comprising:

a drill string configured to be conveyed along the borehole;

a flex sub positioned along the drill string, the flex sub having a tubular with a reduced diameter flex section connecting a first end to a second end, the flex section having a surface that is continuously radially recessed from an outer surface of the first end and an outer surface of the second end, the flex sub having a bore extending from the first end to the second end;

a segmented shell disposed around the radially recessed surface, the shell being configured to be more flexible than the flex section, the shell having an outer surface that is flush with the outer surfaces of the first end and the second end;

at least one module embedded in the shell, the at least one module including at least one sensor configured to estimate a selected parameter of interest; and a positioning module connected to the flex sub, the positioning module having a plurality of independently extendable ribs configured to engage a borehole wall and selectively laterally displace the flex sub in the borehole, wherein the drill string and the flex sub convey a drilling fluid to an exit of the drill string; and wherein:

the flex section is made of a metal and the segments are formed of a non-metal; and the module further includes at least one of: (i) memory module storing information related to the estimated selected parameter of interest, (ii) a transmitter transmitting the information related to the estimated selected parameter of interest, and (iii) a battery supplying power to the at least one sensor.

12. A method for performing a selected operation in a borehole formed in an earthen formation, comprising:

forming a work string having:

a flex sub having a reduced diameter flex section connecting a first end to a second end, the flex section having a surface radially recessed from an outer surface of the first end and a second end, the flex sub having a bore extending from the first end to the second end; and a shell disposed around the radially recessed surface, the shell being configured to be more flexible than the flex section, wherein:

the shell is formed of segments;

the flex section is made of a metal and the segments are formed of a non-metal; and at least one module is embedded in the shell;

flowing a drilling fluid through the flex sub and the work string to an exit of the work string; and conveying the work string through the borehole.

13. The method of claim 12, wherein the shell includes at least one module configured to estimate a selected parameter of interest, and further comprising estimating the selected parameter of interest using the at least one module.

14. The method of claim 13, wherein the at least one module includes at least one of: (i) a sensor embedded in the shell, the at least one sensor being configured to estimate a selected parameter of interest, (ii) a memory module storing information related to the estimated selected parameter of interest, (iii) a transmitter transmitting the information related to the estimated selected parameter of interest, and (iv) a battery supplying power to the at least one sensor.

15. The method of claim 12, further comprising at least one sensor embedded in the shell, the at least one sensor being configured to estimate a selected parameter of interest and wherein at least one signal carrier extends through the flex section, and further comprising transmitting signals between the at least one signal carrier and the at least one sensor.

16. The method of claim 12, wherein the shell includes a plurality of segments distributed at least one of: (i) circumferentially, and (ii) axially.

17. The method of claim 12, wherein a positioning module is connected to the flex sub, the positioning module having a plurality of independently extendable ribs configured to selectively laterally position the flex sub in the borehole, and further comprising laterally displacing the flex sub using the positioning module.

18. The method of claim 12, further comprising:

estimating a parameter of interest while the flex sub is in a first lateral position to obtain a first data set;

laterally displacing the flex sub with the positioning module; and estimating the parameter of interest while the flex sub is in a second lateral position to obtain a second data set.

* * * * *